United States Patent [19]

Reverberi

[11] 4,190,905

[45] Mar. 4, 1980

[54] FOLDING GARMENT

[76] Inventor: Leo Reverberi, 5, passage de la Main d'Or, Paris, France, 75011

[21] Appl. No.: 862,132

[22] Filed: Dec. 19, 1977

[51] Int. Cl.[2] ..... A41D 15/00

[52] U.S. Cl. ..... 2/1; 2/82; 2/87

[58] Field of Search ..... 2/1, 82, 87, 301, 338

[56] References Cited

U.S. PATENT DOCUMENTS

| | | | |
|---|---|---|---|
| 1,864,948 | 6/1932 | Schmidt | 2/87 |
| 1,989,140 | 1/1935 | Lefkowitz | 2/87 X |
| 2,620,477 | 12/1952 | Ackerman et al. | 2/87 |
| 3,981,026 | 9/1976 | Reverberi | 2/87 X |

FOREIGN PATENT DOCUMENTS

| | | | |
|---|---|---|---|
| 2323343 | 4/1977 | France | 2/87 |

*Primary Examiner*—Louis Rimrodt
*Attorney, Agent, or Firm*—Arthur T. Fattibene

[57] ABSTRACT

The present invention is an improvement of the inventor's French patent No. 2,323,343.

The present invention comprises three improvements of which the first provides that the sleeves are adjoined by an oblique folding line which extends from the armpit to the neck; the second provides that the sleeves are adjoined horizontally to form a "T" with the rest of the garment and the folding lines extend transversely to the sleeves; the third improvement provides a strip enveloping the garment partly or completely as soon as the garment is folded to a strip.

These improvements increase the comfort in use of folding waterproof garments.

8 Claims, 15 Drawing Figures

FOLDING GARMENT

The present invention is an improvement of inventor's French application No. 74 29 601 of Aug. 30, 1974, and No. 75 27 648 of Sept. 9, 1975, now French Pat. No. 2,323,345, in which folding waterproof garments are described.

Figure 1:
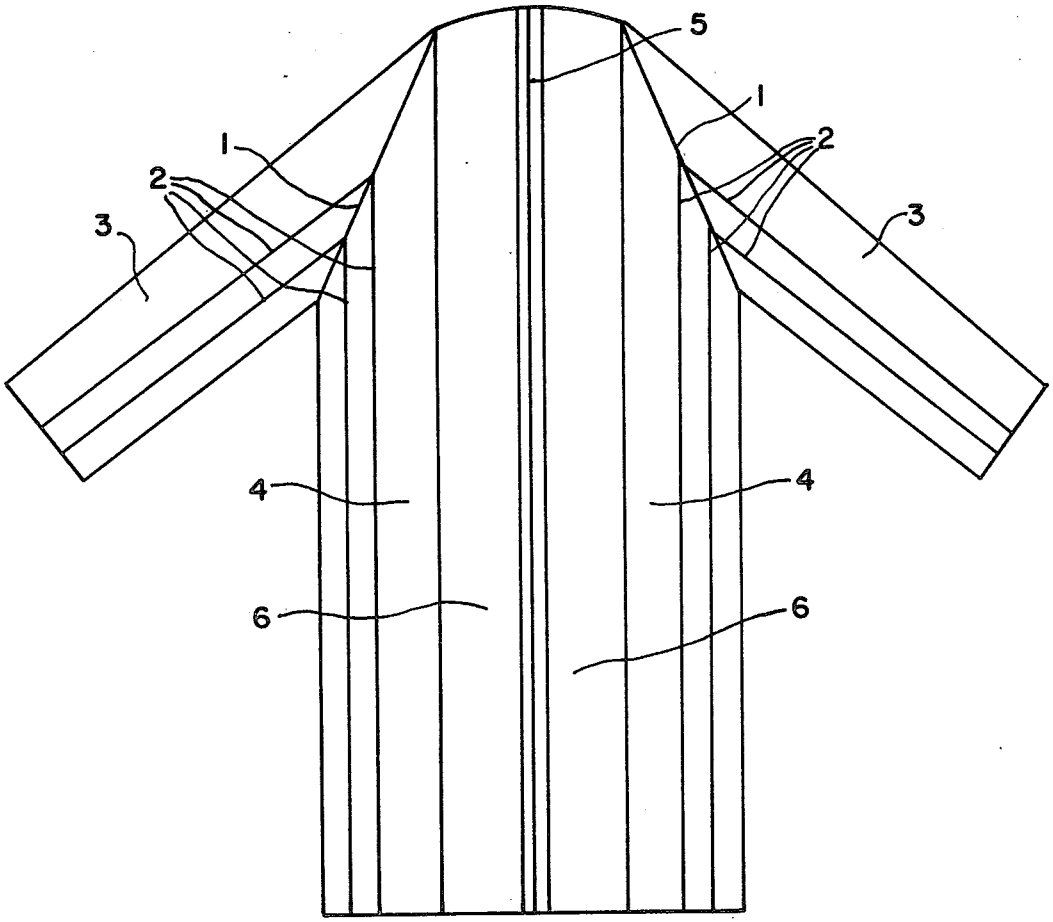
FIG. 1 is a plan view of a foldable garemnt embodying the present invention.

The present invention comprises several improvements of the folding waterproof garment, of which the first one, FIG. 1, is a provision that the sleeves are adjoined to the garment body by oblique folding lines 1 which extend from the armpit to the neck, so that the longitudinal folding lines of the sleeves and the longitudinal folding lines of one part of the garment body take relative to each other a configuration resembling a spike 2.

Figure 2:
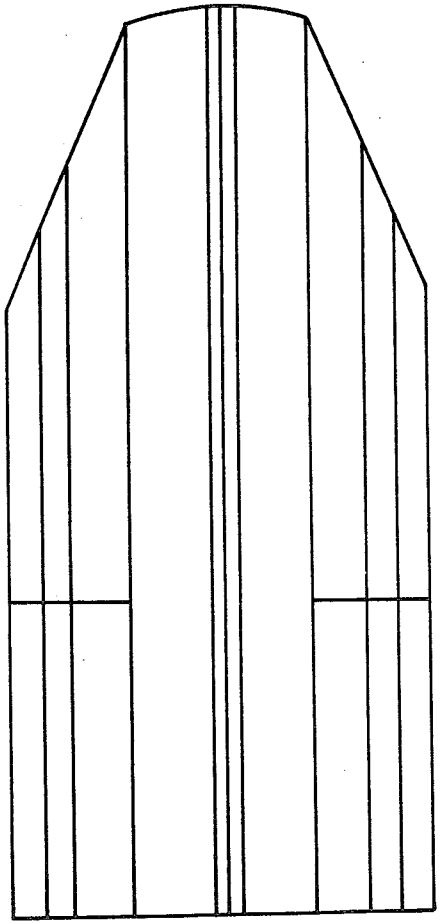
FIG. 2 is a plan view of the foldable garment of FIG. 1 illustrating the garment in a partially folded position wherein the sleeve portions are folded onto the body portion.
Figure 4:
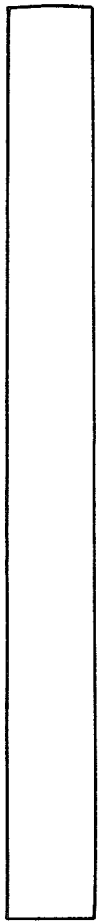
FIG. 4 is a plan view of the finally folded position of the garment of FIGS. 1 to 3.
Figure 3:
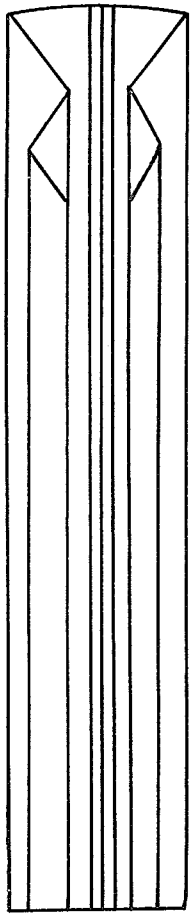
FIG. 3 is a plan view of the foldable garment of FIG. 1 illustrating a further intermediate folded position of said garment.

The oblique folding lines make it possible to fold the non-folded sleeves over the garment body, FIG. 2, in order to fold them along with this body, FIG. 3, to form a folded strip FIG. 4.

The longitudinal folding lines divide the garment into strips of which the exterior strips 3 of the sleeves and the garment body strips 4 adjoined thereto by the oblique folding lines are wider than the other strips, with the exception of the strips on either side of the center folding line 5, and the boarder strip or strips 6 of the front area which are the widest ones of all the strips.

Figure 5:
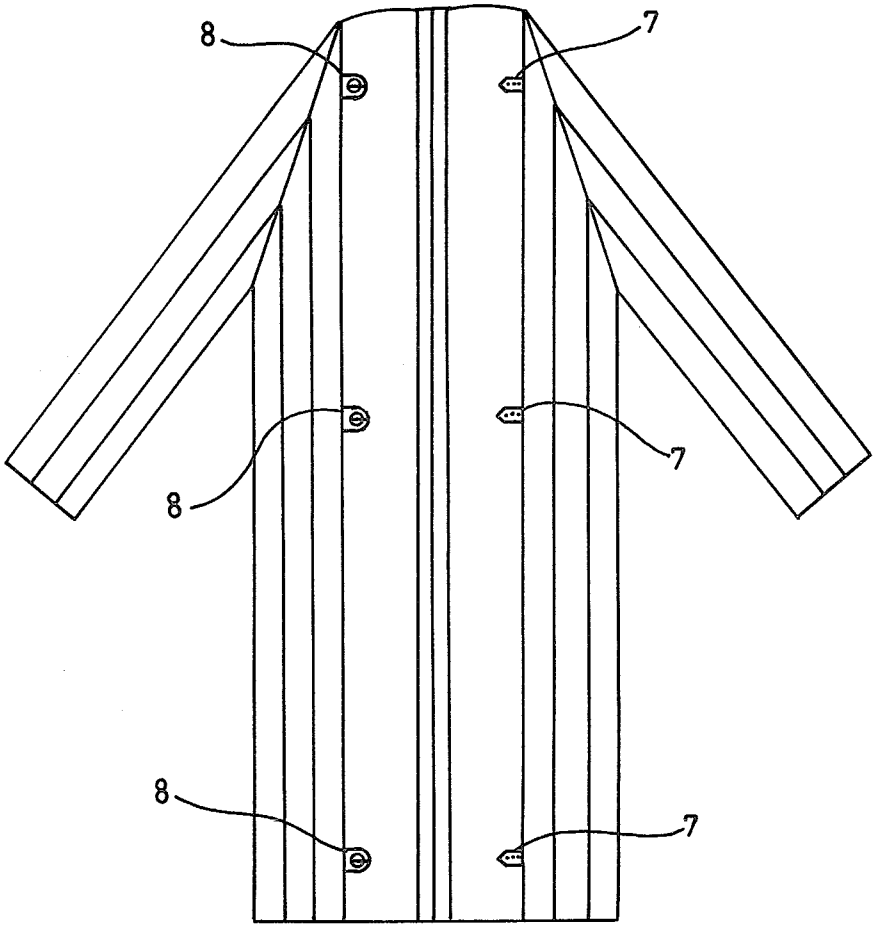
FIG. 5 is a plan view of a modified form of the folding garment.

This disposition of the strips is provided in order to make it possible to close the garment folded to a strip, but as shown in FIG. 5, all the strips may also be made equal to each other, with the exception of those on either side of the central folding line and of the two front boarder strips.

In this case, it will be sufficient to affix tongues 7 and closing means 8 along the folding lines which extend on either side of the central folding line or along the folding lines of the two limitrophe strips. Tongues and closing means will always be placed inwardly of the folding lines.

Figure 6:
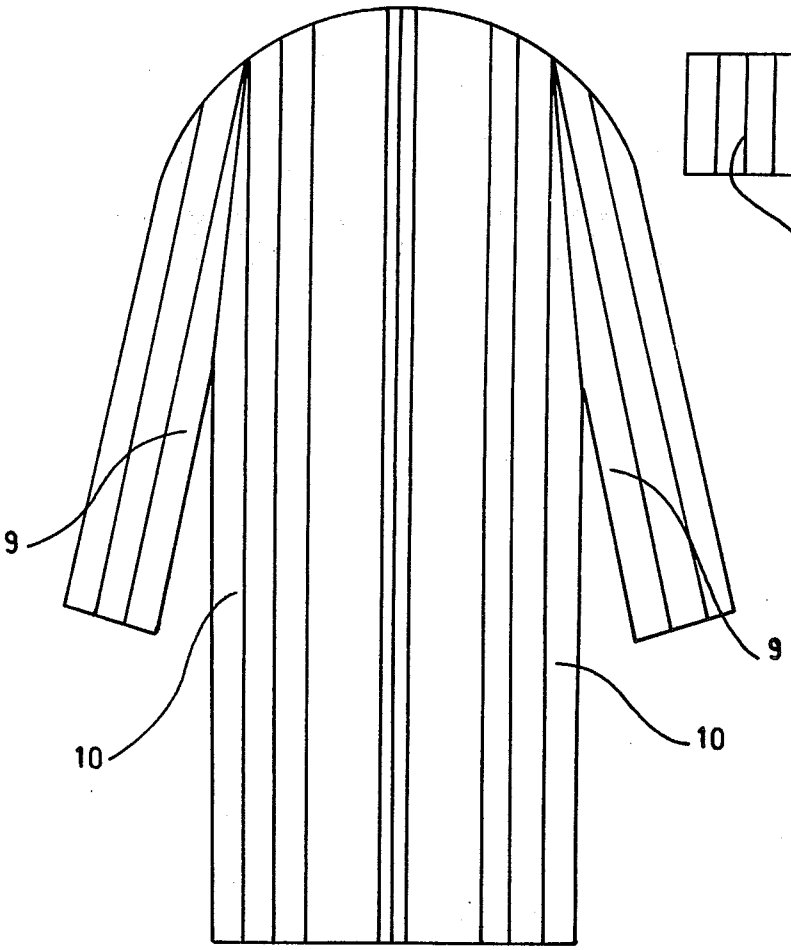
FIG. 6 is a plan view of another modified form of the foldable garment.

According to another design shown in FIG. 6, the number of longitudinal folding lines, which are traversed by the oblique folding line are variable so that the oblique folding line may be formed by the junction of one sleeve strip 9 with one garment body strip 10 which both are cut to a bevel, so that none of the longitudinal folding lines is crossed.

To obtain a satisfactory result, all of the folding lines must coincide with each other, the projecting lines with the projecting lines, and the recessed lines with the recessed lines.

The purpose of this improvement is to facilitate the folding of the garment by turning the sleeves back on the garment body, on the one hand, and to facilitate slipping of the arms into the sleeves by providing the oblique junction, on the other hand.

Figure 7:
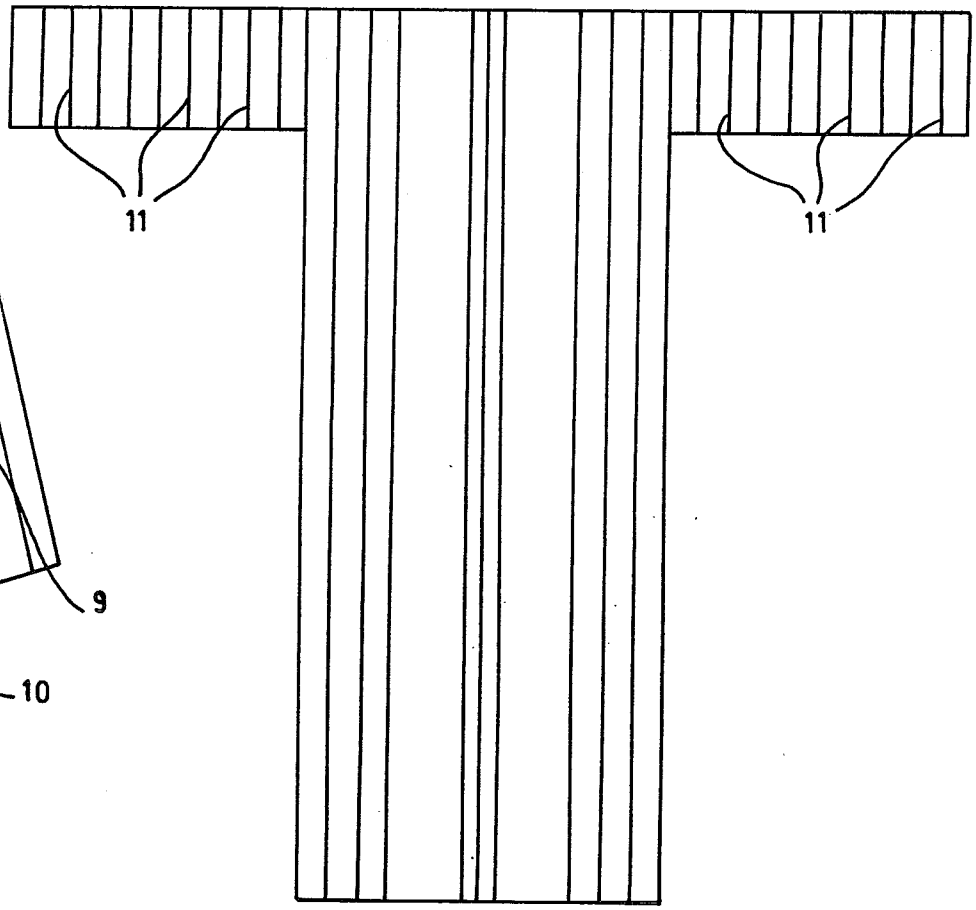
FIG. 7 is a plan view of another modified embodiment.
Figure 10:
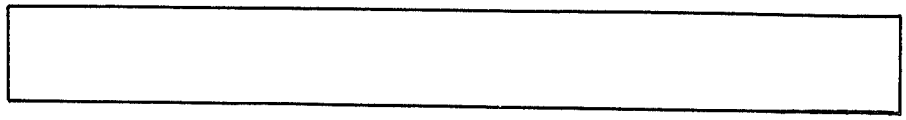
FIG. 10 is a plan view of the garment of FIGS. 7, 8 and 9 in a finally folded position.
Figure 9:
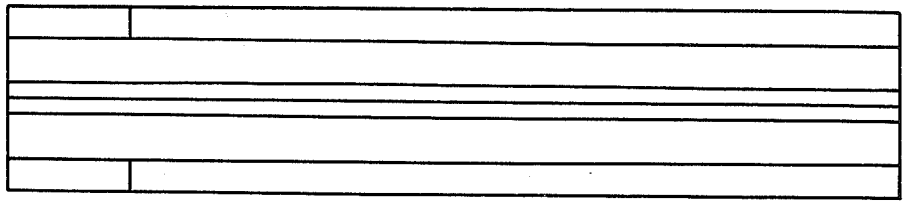
FIG. 9 is a plan view of the foldable garment of FIGS. 7 and 8 illustrating the garment in a further intermediate folded position.
Figure 8:
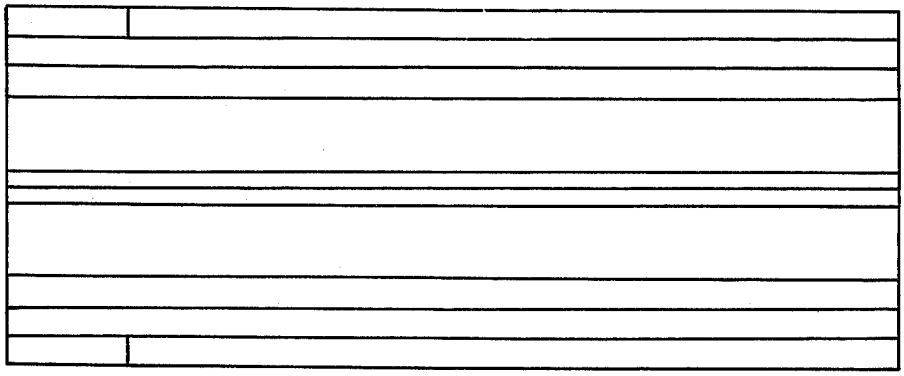
FIG. 8 is a plan view of the foldable garment of FIG. 7 illustrated in a partially folded position wherein the sleeve portions are accordian folded onto the body portion.

In the second improvement shown in FIG. 7, the sleeves are jointed to the garment body horizontally so as to form a "T"; the folding lines 11 of the sleeves are provided transversely thereto. The sleeves are folded first, separately, FIG. 8, and then along with the garment body, FIG. 9, until the final strip, FIG. 10, is formed.

In this case, as in the preceding example, the result aimed at is to make the folding and donning of the garment easier.

Figure 12:
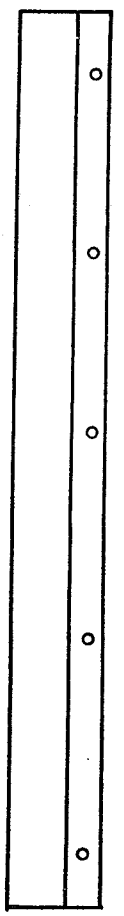
FIG. 12 is a plan view of the garment shown in FIG. 11 in a further folded position.
Figure 11:
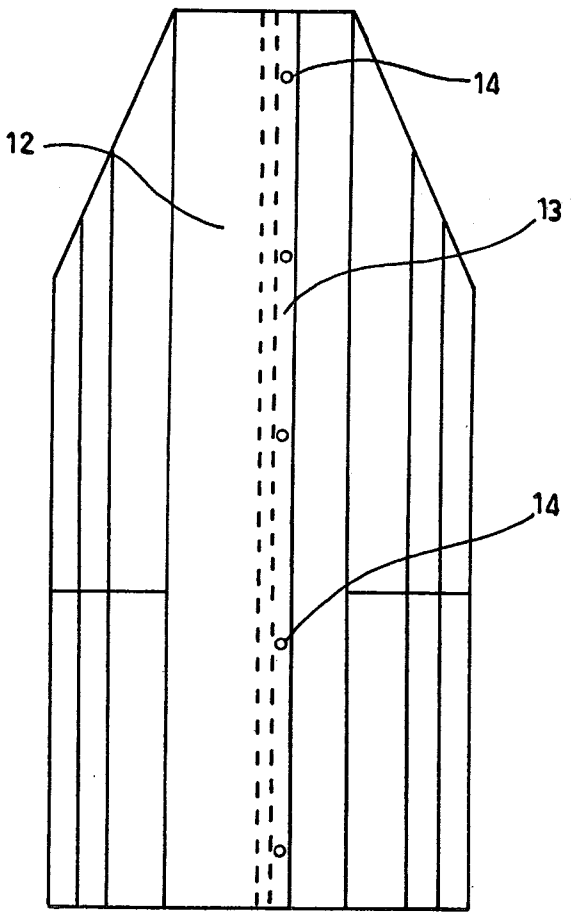
FIG. 11 is a plan view of another modified garment embodiment wherein the sleeve portions are shown in folded position onto the body portion of the garment.

In the third improvement shown in FIG. 11, the front area is divided into two unequal parts of which the strip 12 is wider than the strip 13. On their borders, the strips 12 and 13 are provided with complementary closing means 14, and after the garment is completely folded, FIG. 12, the width in excess of the wider strip 12 is turned back on the narrower strip 13, for attaching the two strips to each other by the complementary closing means.

Figure 13:
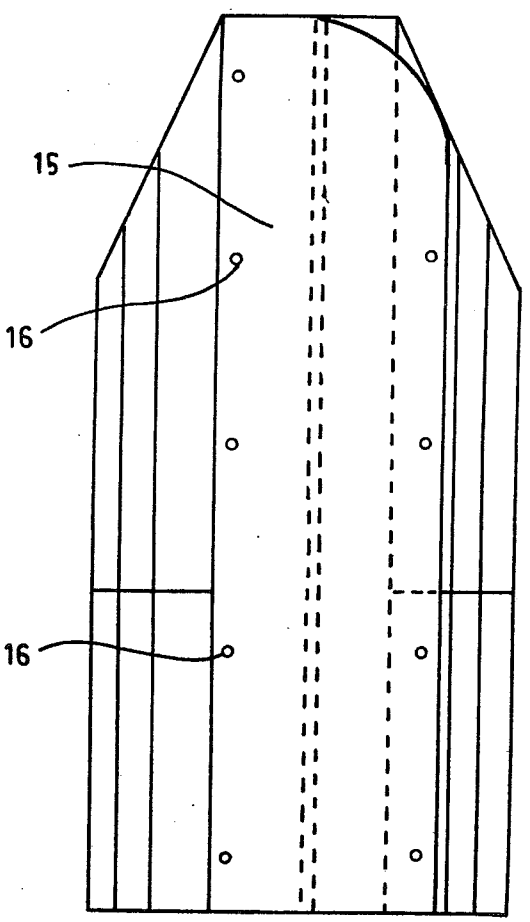
FIG. 13 is a plan view of still another embodiment in which the sleeve portions are shown in a folded position onto the body of the garment.

In another embodiment, FIG. 13, the broader strip 15 is about one and a half times wider than the finally folded strip of garment. This broad strip 15 comprises, in addition, the usual complementary fastening means, namely a row of fastening means 16 provided at the folding line. After the garment is folded to a strip, it is completely enveloped by this broad strip and closed into itself.

Figure 15:
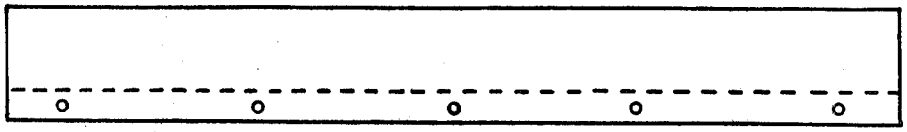
FIG. 15 illustrates the plan view of the garment of FIG. 14 in its final folded position.
Figure 14:
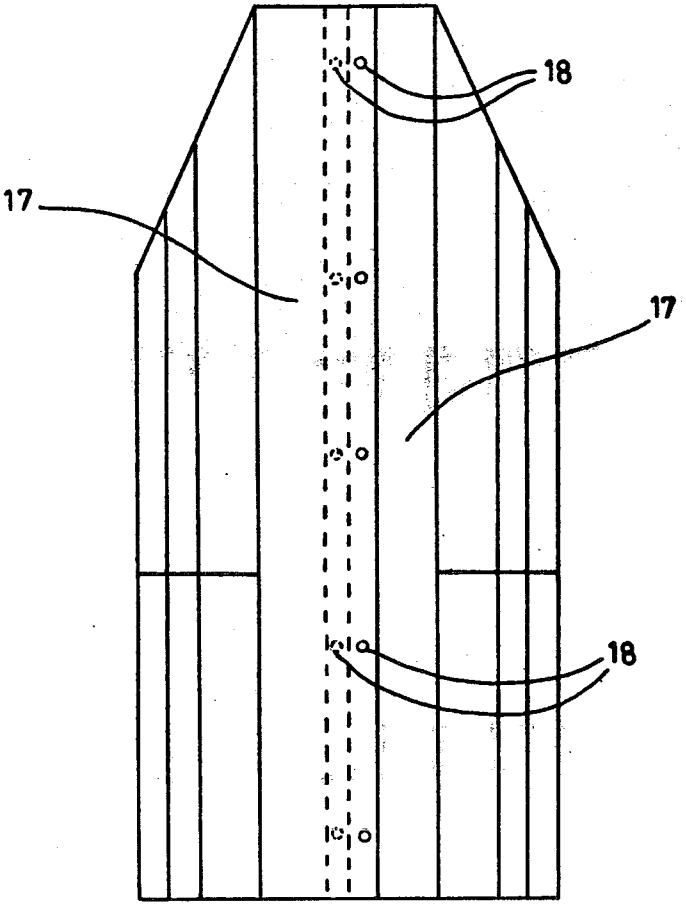
FIG. 14, is a plan view of still another embodiment of the invention.

In still another embodiment, FIG. 14, the two parts of the front area are of equal width and their strips 17 are slightly wider than the adjacent strips. On their borders, the strips 17 are provided with complementary closing means 18 on both sides of the garment cloth, which makes it possible to close the garment both in itself and in its form as final strip, by attaching the two strips 17 to each other, border to border, by the interior and exterior garment closing means, as shown in FIG. 15.

These improvements of folding waterproof garments which can be worn around the waist are intended to facilitate their use and, consequently, increase the commercial success.

I claim:

1. A foldable garment having a body portion and a pair of sleeve portions connected to said body portions whereby said sleeve portions are connected to said body portion along an oblique seam extending from the armpit to the neck, the improvement comprising said sleeve having a plurality of longitudinally extending foldlines formed therein, and said body portion having a plurality of longitudinally extending foldlines formed therein, the foldlines of said sleeves and said body portions being disposed on opposite sides of said oblique seam, wherein said longitudinal sleeve foldlines and body foldlines define a plurality of corresponding sleeve strips and body strips respectively, whereby the respective sleeve strips and corresponding adjacent body strips which join along said oblique seam are each substantially equal in width, said sleeve being readily foldable along said oblique seam to overlap said body portion in a folded position of said garment whereby the foldlines of said sleeves are disposed congruently to the foldlines of said body portion so that said body portion and overlying sleeves can be further jointly folded along said congruent foldlines to define a finally folded elongated panel.

2. A foldable garment as defined in claim 1 wherein said longitudinal sleeve fold lines and body fold lines define a plurality of corresponding sleeve strips and body strips respectively whereby the outermost sleeve strip and corresponding body strip are wider than the other formed sleeve strips and body strips which join along said oblique seam.

3. A foldable garment as defined in claim 1 or 2 and said body portion includes a boarder strip connected along each opposed inmost body fold line respectively, and complementary closure means disposed at spaced intervals along the respective inmost fold lines of said body portion, said closure means including a tongue spaced along one of said innermost fold lines and a complementary closure spaced along the other innermost fold line.

4. A foldable garment as defined in claim 1 or 2 wherein said oblique seam traverses each of the respective sleeve strips defined by said sleeve fold line.

5. A foldable garment defined in claim 1, wherein the oblique seam extends from the juncture of the innermost strip of said sleeve and the outermost body strip defined by said sleeve and body fold lines to said neck.

6. A foldable garment as defined in claim 1 wherein said body portion includes a front portion having two boarder strips of unequal widths, complementary fastening means connected to the respective adjacent edge portions of said boarder strips.

7. A foldable garment as defined in claim 1 wherein said body portion includes a front strip approximately one and one half times wider than the finally folded garment, complementary fastening means spaced longitudinally along the opposed edges of said front strip, said front strip in the folded position of said garment defining an envelope for said folded garment.

8. A foldable garement as defined in claim 1 wherein said body portion comprises a front portion having a pair of equal width strips, and complementary fastening means longitudinally disposed along the respective marginal edges of said equal width strips, said fastening means being disposed on both sides of said strips whereby said garment can be fastened in either the folded or unfolded position thereof.

* * * * *